US005514636A

United States Patent [19]

Takeuchi

[11] Patent Number: 5,514,636

[45] Date of Patent: May 7, 1996

[54] HEAT-SENSITIVE RECORDING MATERIAL

[75] Inventor: Koh Takeuchi, Shizuoka, Japan

[73] Assignee: Fuji Photo Film Co., Ltd., Kanagawa, Japan

[21] Appl. No.: 530,743

[22] Filed: Sep. 19, 1995

[30] Foreign Application Priority Data

Sep. 27, 1994 [JP] Japan ..... 6-231607

[51] Int. Cl.[6] ..... B41M 5/40

[52] U.S. Cl. ..... 503/207; 427/152; 503/200; 503/226

[58] Field of Search ..... 427/150–152; 503/200, 207, 226

[56] References Cited

U.S. PATENT DOCUMENTS 4,948,775 8/1990 Tsuji et al. ..... 503/207

*Primary Examiner*—Bruce Hess

*Attorney, Agent, or Firm*—Sughrue, Mion, Zinn, Macpeak & Seas

[57] ABSTRACT

A heat-sensitive recording material which is highly transparent and resistant to sticking. The recording material comprises a support, having thereon in the following order, a heat-sensitive recording layer and a protective layer comprising a pigment, a binder and a wax. The wax has a melting point of from 40° C. to 100° C. and said wax comprises wax particles having a 50% volume-average particle diameter of not more than 0.7 μm. Furthermore, the protective layer contains the pigment in an amount of not more than 100 parts per 100 parts by weight of binder.

11 Claims, No Drawings

HEAT-SENSITIVE RECORDING MATERIAL

FIELD OF THE INVENTION

The present invention relates to a heat-sensitive recording material. More particularly, the present invention relates to a heat-sensitive recording material which is less prone to stick to the thermal head of a thermal printer.

BACKGROUND OF THE INVENTION

The applications of thermal recording are expanding in the fields of facsimile telegraphs and printers, labels including POS, etc., because this recording technique has the following advantages: (1) wet development is unnecessary, (2) the quality of paper supports for thermal recording materials is similar to that of general paper, (3) handling is easy, (4) developed-color densities are high, (5) the recording apparatus is simple and inexpensive, and (6) the recording operation is noiseless.

Under these circumstances, the development in recent years of a transparent heat-sensitive recording material for directly recording images with a thermal head has been desired in order to satisfy the demand for multicolor recording or to provide recorded images which can be projected with an overhead projector or directly observed on a light table.

Among recent proposals is a transparent heat-sensitive recording material comprising a transparent support, e.g., a synthetic polymer film, having formed thereon a heat-sensitive recording layer containing a substantially colorless color-forming ingredient A and a substantially colorless color-forming ingredient B which develops a color upon reacting with the color-forming ingredient A. These ingredients A and B are incorporated into the heat-sensitive recording layer by dispersing fine particles of both ingredients into a binder or by microencapsulating one of the ingredients and using the other in the form of an emulsion.

Such heat-sensitive recording materials, although having satisfactory transparency, are disadvantageous in that they are prone to stick or generate noise when printed with a thermal recording device, e.g., a thermal printer. To overcome this problem, a technique of coating the heat-sensitive recording layer with a protective layer mainly comprising a pigment and a binder has been proposed.

However, in order to reduce the sticking and noise generation to a satisfactory level by means of a protective layer mainly comprising a pigment and a binder, the proportion of the pigment ingredient in the protective layer is preferably increased to a value equal to or larger than that of the binder ingredient contained in the protective layer. However, such a high pigment proportion may disadvantageously impair transparency. In conventional opaque heat-sensitive recording materials, an increased pigment proportion in the protective layer can also cause problems. For example, the recorded images thereby obtained are blurry and the developed-color density is decreased.

SUMMARY OF THE INVENTION

A first object of the present invention is to provide a transmission-type heat-sensitive recording material which has satisfactory transparency and is suitable for recording with a thermal head.

A second object of the present invention is to provide a reflection-type heat-sensitive recording material which provides clear recorded images without loss of color density and is suitable for recording with a thermal head.

Other objects and effects of the present invention will be apparent from the following description.

The above objects of the present invention are accomplished by a heat-sensitive recording material comprising a support and, formed thereon in the following order, a heat-sensitive recording layer and a protective layer, said protective layer comprising a pigment, a binder and a wax wherein said wax has a melting point of from 40° C. to 100° C. and said wax comprises wax particles having a 50% volume-average particle diameter of from not less than 0.2 μm to not more than 0.7 μm, and said protective layer contains said pigment in an amount of form not less than 0.1 parts to not more than 100 parts by weight per 100 parts by weight of the binder.

To be suitable for recording with a thermal head, it is usually necessary to form a protective layer containing a large amount of a pigment ingredient. Such increased pigment proportions have posed problems in that the transparency of the protective layer is reduced and recorded images are blurry and have a reduced color density. As a result of extensive studies, the present inventors have discovered that a heat-sensitive recording material which is suitable for recording with a thermal head and is not prone to stick even when the pigment amount in the protective layer is reduced to 100 parts by weight or less, and surprisingly to 50 parts by weight or less, per 100 parts by weight of the binder, is obtained by incorporating into the protective layer a wax having a melting point of from 40° C. to 100° C. and comprising wax particles having a 50% volume-average particle diameter as measured by a laser diffraction method of not more than 0.7 μm, especially preferably not more than 0.4 μm.

DETAILED DESCRIPTION OF THE INVENTION

Pigment amounts in the protective layer larger than 100 parts by weight per 100 parts by weight of the binder are undesirable in that the transparency of the heat-sensitive recording material is reduced. The pigment amounts in the protective layer of the present invention is preferably from not less than 25 parts to not more than 50 parts by weight per 100 parts by weight of the binder for preventing the protective layer from sticking. Also, in the case of a reflection type heat-sensitive recording material, a blurry image having a reduced color density is obtained. A known organic or inorganic pigment may be employed as the pigment for use in the protective layer. Especially preferred are aluminum hydroxide, calcium carbonate, kaolin, and silica. Pigments obtained by treating the surface of the above-described pigments with a metal salt of a higher fatty acid, a higher fatty amide, a higher fatty ester, a higher aliphatic hydrocarbon, or the like are also useful. These pigments are used after being converted to a dispersion of fine particles by a known dispersion technique. The pigments are preferably dispersed to the extent that the average particle diameter thereof (50% volume-average particle diameter as measured with a laser diffraction type particle diameter analyzer) is from not less than 0.3 μm to not more than 1.0 μm, preferably not more than 0.5 μm.

The fine wax particles for use in the protective layer in the present invention have a 50% volume-average particle diameter, as measured with a laser diffraction type particle diameter analyzer, of from not less than 0.2 μm to not more than 0.7 μm, especially preferably not more than 0.4 μm. An average particle diameter thereof exceeding 0.7 μm is undesirable in that transparency is reduced and blurry images result. The fine wax particles for use in the protective layer of the present invention, which have been dispersed at or below the average particle diameter specified above, are fine particles of a wax having a melting point of from 40° C. to 100° C. If the melting point thereof is lower than 40° C., the surface of the protective layer is tacky and this causes handling problems. Melting points of the wax higher than 100° C. are undesirable in that the problem of sticking is still present. The wax preferably has a melting points of from 50° C. to 90° C.

Examples of the wax having a melting point of from 40° C. to 100° C. include petroleum waxes such as paraffin wax and microcrystalline wax, synthetic waxes such as polyethylene wax, vegetable waxes such as candelilla wax, carnauba wax, and rice wax, animal waxes such as lanolin, and mineral waxes such as montan wax. Especially preferred of these are waxes having a melting point of from 55° C. to 75° C. The addition amount of the wax is from 0.5 to 40% by weight, preferably from 1 to 20% by weight, based on the total weight of the protective layer. These waxes may be used in combination with a 12-hydroxystearic acid derivative, a higher fatty amide, or the like.

For dispersing a wax to a 50% volume-average particle diameter of not more than 0.7 μm, preferably not more than 0.4 μm, a method may be used in which the wax is dispersed with a known wet dispersing machine, e.g., a dynomill or a sand mill, in the presence of an appropriate protective colloid and surfactant. However, preferred methods for reducing size include a method in which a wax is first melted by heating. The melt is then emulsified at a temperature not lower than the melting point of the wax into a solvent in which the wax is insoluble or slightly soluble using an ordinary means for emulsifying fine particles, e.g., high-speed agitation or ultrasonic dispersion. In a second method, a wax is dissolved in an appropriate solvent and the solution is emulsified into a solvent in which the wax is insoluble or slightly soluble. In this emulsification, a suitable surfactant and protective colloid may be used.

Examples of the binder resin for use in the protective layer in the present invention include water-soluble polymer compounds such as methyl cellulose, carboxymethyl cellulose, hydroxyethyl cellulose, polyvinyl alcohol, carboxy-modified polyvinyl alcohol, acetoacetylated polyvinyl alcohol, silanol-modified polyvinyl alcohol and polyacrylamide; polyethylene and copolymers thereof, polystyrene and copolymers thereof, polyesters and copolymers thereof, and (meth)acrylate and water dispersion products of copolymers thereof.

The composition of the heat-sensitive recording layer of the heat-sensitive recording material of the present invention is not particularly limited as long as the recording layer develops color upon heating. Examples of such a heat-sensitive recording layer include a two-component-type heat-sensitive recording layer containing a substantially colorless color-forming ingredient A and a substantially colorless color-forming ingredient B which develops a color upon reacting with the color-forming ingredient A. Examples of combinations of the two ingredients include the following (a) to (m).

(a) Combinations of a photo-decomposable diazo compound and a coupler.

(b) Combinations of an electron-donating dye precursor and an electron-accepting compound.

(c) Combinations of an organic metal salt such as silver behenate or silver stearate and a reducing agent such as protocatechuic acid, spiroindane, or hydroquinone.

(d) Combinations of a long-chain fatty acid salt such as ferric stearate or ferric myristate and a phenol derivative such as gallic acid or ammonium salicylate.

(e) Combinations of a salt of an organic acid such as acetic acid, stearic acid, or palmitic acid with a heavy metal such as nickel, cobalt, lead, copper, iron, mercury, or silver and a sulfide of an alkaline earth metal such as calcium sulfide, strontium sulfide, or potassium sulfide; or combinations of such a heavy metal salt of an organic acid and an organic chelating agent such as s-diphenylcarbazide or diphenylcarbazone.

(f) Combinations of a (heavy) metal sulfate such as silver sulfide, lead sulfide, mercury sulfide, or sodium sulfide and a sulfur compound such as Na-tetrathionate, sodium thiosulfate, or thiourea.

(g) Combinations of a ferric salt of a fatty acid such as ferric stearate and an aromatic polyhydroxy compound such as 3,4-dihydroxytetraphenylmethane.

(h) Combinations of a noble metal salt of an organic acid such as silver oxalate or mercury oxalate and an organic polyhydroxy compound such as a polyhydroxy alcohol, glycerol, or a glycol.

(i) Combinations of a ferric salt of a fatty acid such as ferric pelargonate or ferric laurate and either thiocetylcarbamide or an isothiocetylcarbamide derivative.

(j) Combinations of a lead salt of an organic acid such as lead caproate, lead pelargonate, or lead behenate and a thiourea derivative such as ethylenethiourea or N-dodecylthiourea.

(k) Combinations of a heavy metal salt of a higher fatty acid such as ferric stearate or copper stearate and a zinc dialkyldithiocarbamate.

(l) Combinations which form an oxazine dye, such as combinations of resorcinol and a nitroso compound.

(m) Combinations of a formazan compound and a reducing agent and/or a metal salt.

Preferred of these in the present invention are combinations (a), i.e., combinations of a photo-decomposable diazo compound and a coupler, combinations (b), i.e., combinations of an electron-donating dye precursor and an electron-accepting compound, and combinations (c), i.e., combinations of an organic metal salt and a reducing agent, with combinations (a) and combinations (b) being especially preferred.

For controlling the haze of the heat-sensitive recording material, wherein haze is represented by $$\frac{\text{diffusion transmittance}}{\text{total light transmittance}} \times 100\ (\%),$$

to not more than 40%, the following methods, for example, may be used: a method in which the fine particles of ingredients A and B contained in the heat-sensitive recording layer are adjusted to have a 50% volume-average particle diameter of not more than 1.0 μm, preferably not more than 0.6 μm, and the amount of the binder contained in the heat-sensitive recording layer is adjusted to from 30 to 60% by weight based on the total amount of all solid components in the heat sensitive recording layer; and a method in which either of ingredients A and B is microencapsulated and the other is used in a form which provides a substantially continuous layer after application and drying, e.g., used in the form of an emulsion. Also effective is a technique of forming a heat-sensitive recording layer from ingredients having refractive indexes as close as possible to a predetermined value. Haze is an index which indicates the transparency of a material, and is generally calculated from the total amount of transmitted light, the amount of diffusion-transmitted light, and the amount of parallel-transmitted light as measured with a haze meter. The heat-sensitive recording material of the present invention preferably has a haze value of from 5 to 40%, and particularly preferably from 5 to 35%.

The heat-sensitive recording layer employing a combination of an electron-donating dye precursor and an electron-accepting compound is described below. The electron-donating dye precursor for use in the present invention is not particularly limited, as long as it is a substantially colorless substance which develops color upon donating an electron or receiving a proton from an acid, etc. This dye precursor is preferably a substantially colorless compound which has a lactone, lactam, sultone, spiropiran, ester, or amide skeleton or a similar skeleton, and this skeleton undergoes ring opening or cleavage upon contact with a developer. Examples of the electron-donating dye precursor include various compounds such as triphenylmethanephthalide compounds, fluoran compounds, phenothiazine compounds, indolylphthalide compounds, leuco Auramine compounds, Rhodamine lactam compounds, triphenylmethane compounds, triazene compounds, spiropyran compounds, and fluorene compounds. Specific examples of the phthalide compounds are given in U.S. Pat. No. Re. 23,024 and U.S. Pat. Nos. 3,491,111, 3,491,112, 3,491,116, and 3,509,174. Specific examples of the fluoran compounds are given in U.S. Pat. Nos. 3,624,107, 3,627,787, 3,641,011, 3,462,828, 3,681,390, 3,920,510, and 3,959,571. Specific examples of spirodipyran compounds are given in U.S. Pat. No. 3,971,808. Specific examples of pyridine compounds and pyrazine compounds are given in U.S. Pat. Nos. 3,775,424, 3,853,869, and 4,246,318. Specific examples of the fluorene compounds are given in, e.g., Japanese Patent Application No. 61-240989.

Particularly effective of these are black-developing 2-arylamino-3-(H, halogen, alkyl, or alkoxy)-6-(substituted amino)fluorans. Specific examples thereof include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran, and 2-anilino-3-methyl-6-N-ethyl-N-γ-propoxypropylaminofluoran.

The electron-accepting compound for use in combination with these electron-donating dye precursors may be a phenol compound or an acid substance such as an organic acid or a metal salt thereof or a hydroxybenzoic acid ester. Examples of such compounds are given, e.g., in JP-A-61-291183. (The term "JP-A" as used herein means an "unexamined published Japanese patent application.") Specific examples of the electron-accepting compound include bisphenols and analogues thereof such as 2,2-bis(4'-hydroxyphenyl)propane (generally called bisphenol A), 2,2-bis(4'-hydroxyphenyl-)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)-propane, 1,1-bis(4'-hydroxyphenyl)butane, 1,1-bis(4'-hydroxyphenyl-)pentane, 1,1-bis(4'-hydroxyphenyl)hexane, 1,1-bis(4'-hydroxyphenyl)heptane, 1,1-bis(4'-hydroxyphenyl)-octane, 1,1-bis(4'-hydroxyphenyl)-2-methylpentane, 1,1-bis(4'-hydroxyphenyl)-2-ethylhexane, 1,1-bis(4'-hydroxyphenyl-)dodecane, 1,4-bis(p-hydroxyphenylcumyl)benzene, 1,3-bis(p-hydroxyphenylcumyl)benzene, bis(p-hydroxyphenyl) sulfone, bis(3-allyl-4-hydroxyphenyl) sulfone, and benzyl bis(p-hydroxyphenyl)acetate; salicylic acid derivatives such as 3,5-di-α-methylbenzylsalicylic acid, 3,5-di-t-butylsalicylic acid, 3-α,α-dimethylbenzylsalicylic acid, and 4-(β-p-methoxyphenoxyethoxy)salicylic acid and salts of these acids with a polyvalent metal (especially preferably zinc or aluminum); hydroxybenzoic acid esters and analogues thereof such as benzyl p-hydroxybenzoate, 2-ethylhexyl p-hydroxybenzoate, and 2-phenoxyethyl β-resorcylate; and phenols and analogues thereof such as p-phenylphenol, 3,5-diphenylphenol, cumylphenol, 4-hydroxy-4'-isopropoxydiphenyl sulfone, and 4-hydroxy-4'-phenoxydiphenyl sulfone. Of these compounds, the bisphenols and analogues thereof are preferred for improving color-developing properties. The addition amount of the developer is preferably from 50 to 800% by weight, preferably from 100 to 500% by weight, based on the weight of the color former. The developers enumerated above may be used in combination of two or more thereof.

The heat-sensitive recording layer employing a combination of a photo-decomposable diazo compound and a coupler is described next. The photo-decomposable diazo compound for use in the present invention is a diazo compound which produces a desired hue upon reacting with a developer called a coupling ingredient, described below. Upon exposure to light having a specific wavelength prior to contacting with a coupling ingredient, the diazo compound decomposes and is no longer able to produce a color even upon contacting with the coupling ingredient. The hue obtained with this color-developing system is determined by the diazo dye formed by the reaction of the diazo compound with the coupling ingredient. It is hence possible to easily obtain various developed colors by changing the chemical structure of the diazo compound or of the coupling ingredient, as is well known. Almost any color can be developed by selecting appropriate combinations of the two ingredients.

The photo-decomposable diazo compound of the present invention is generally an aromatic diazo compound. More particularly, the photo-decomposable diazo compound is an aromatic diazonium salt, a diazo sulfonate compound, or a diazo amino compound. The diazonium salt is a compound represented by the general formula $ArN_2^+X^-$ wherein Ar represents a substituted or unsubstituted aromatic moiety, $N_2^+$ represents a diazonium group, and $X^-$ represents an acid anion. Examples of the substituent of the aromatic moiety include:

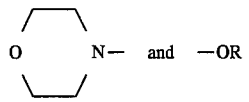

wherein R represents a straight or branched alkyl group having 1 to 8 carbon atoms. A large number of diazo sulfonate compounds are known, which are obtained by treating the corresponding diazonium salts with a sulfite. The diazo amino compound is obtained. by coupling a diazo group with dicyandiamide, sarcosine, methyltaurine, N-ethylanthranic acid-5-sulfonic acid, monoethanolamine, diethanolamine, guanidine, or the like. Details of these diazo compounds are given, e.g., in JP-A-2-136286.

The coupling ingredient to be coupled with the diazo compound of the present invention is usually called a coupler. Examples thereof include 2-hydroxy-3-naphthoic acid anilide and the coupling compounds described in JP-A-62-146678 including resorcinol.

When a combination of a diazo compound and a coupling ingredient is used in the present invention, a basic substance may be added as a sensitizer. This is because the coupling reaction more readily proceeds in a basic environment. This basic substance may be a water-insoluble or slightly water-soluble basic substance or a substance which generates an alkali upon heating. Examples of useful basic substances include nitrogen-containing compounds such as inorganic and organic ammonium salts, organic amines, amides, urea and thiourea and derivatives thereof, and nitrogen compounds such as thiazole, pyrrole, pyrimidine, piperazine, guanidine, indole, imidazole, imidazoline, triazole, morpholine, piperidine, amidines, formamidine, pyridine, and the like and derivatives of such nitrogen-containing compounds. Specific examples of these compounds are given, e.g., in JP-A-61-291183.

For controlling the haze of the heat-sensitive recording material, where haze is represented by $$\frac{\text{diffusion transmittance}}{\text{total light transmittance}} \times 100\ (\%),$$

to not more than 40%, the use of a combination of a photo-decomposable diazo compound and a coupler or a combination of an electron-donating dye precursor and an electron-accepting compound is preferred. Furthermore, the photo-decomposable diazo compound and the electron-donating dye precursor are preferably used in the form of microcapsules.

For producing microcapsules for use in the present invention, any of the interfacial polymerization method, internal polymerization method, and external polymerization method can be employed. Especially preferred is an interfacial polymerization technique in which a core-forming substance containing an electron-donating dye precursor, a photo-decomposable diazo compound, etc. is emulsified into an aqueous solution containing a water-soluble compound dissolved therein, and a wall of a polymeric substance is then formed over the entire surface of each resulting oil droplet.

The reactants for forming the polymer are added to the inside and/or the outside of the oil droplets. Examples of the polymeric substance include polyurethanes, polyureas, polyamides, polyesters, polycarbonates, urea-formaldehyde resins, melamine resins, polystyrene, styrene-methacrylate copolymers, and styrene-acrylate copolymers. Preferred polymeric substances are polyurethanes, polyureas, polyamides, polyesters, and polycarbonates, with polyurethanes and polyureas being especially preferred. These polymeric substances may be used in combination of two or more thereof. Examples of the water-soluble polymer include gelatin, polyvinylpyrrolidone, and poly(vinyl alcohol).

For example, when using a polyurea as a capsule wall material, microcapsule walls can be easily formed by reacting a polyisocyanate, e.g., a diisocyanate, a triisocyanate, a tetraisocyanate, or a polyisocyanate prepolymer, with a polyamine, e.g., a diamine, a triamine, or a tetramine, a prepolymer having two or more amino groups, piperazine or a derivative thereof, a polyol, or the like in an aqueous medium by interfacial polymerization.

Furthermore, capsule walls made of, for example, a polyurea/polyamide composite material or a polyurethane/polyamide composite material can be produced, for example, from a polyisocyanate and an acid chloride or from a polyamine and a polyol by regulating the pH of the dispersion medium as a reaction medium and then heating the system. Details of a process for producing the capsule walls made of a polyurea/polyamide composite material are given in JP-A-58-66948.

If desired and needed, a metallized dye, a charge control agent, e.g., Nigrosine, or other desired additive ingredients may be added to the microcapsule walls for use in the present invention. These additives may be incorporated into the microcapsule walls during wall formation or at other stages. It is also possible to graft-polymerize a vinyl or another monomer in order to regulate the anti-static properties of capsule wall surfaces as needed.

In order to render the microcapsule walls for use in the present invention substance-permeable at lower temperatures, a plasticizer which is solid at ordinary temperature and preferably has a melting point of not less than 50° C. but desirably not higher than 120° C. may be selected from plasticizers suitable for polymers for use as a microcapsule wall material. For example, in the case of a polyurea or polyurethane wall material, preferred plasticizers include hydroxy compounds, carbamic esters, aromatic alkoxy compounds, organic sulfonamide compounds, aliphatic amide compounds, and arylamide compounds.

In the present invention, the developer is used in the form of a dispersion obtained by dissolving the developer into a slightly water-soluble or water-insoluble organic solvent. The solution is then mixed with an aqueous phase containing a surfactant and having a water-soluble polymer as a protective colloid to emulsify the solution.

The organic solvent for use in emulsifying may be suitably selected from high-boiling oils. Preferred oils include esters, dimethylnaphthalene, diethylnaphthalene, diisopropylnaphthalene, dimethylbiphenyl, diisopropylbi-phenyl, diisobutylbiphenyl, 1-methyl-1-dimethyphenyl-2-phenylmethane, 1-ethyl-1-dimethylphenyl-1-phenylmethane, 1-propyl-1-dimethylphenyl-1-phenylmethane, triarylmethanes (e.g., tritolylmethane and tolyldiphenylmethane), terphenyl compounds (e.g., terphenyl), alkyl compounds, alkylated diphenyl ethers (e.g., propyldiphenyl ether), hydrogenated terphenyls (e.g., hexahydroterphenyl), and diphenyl ether. Of these organic solvents, esters are especially preferably used for promoting stability of the emulsion state.

Examples of the esters include phosphoric esters (e.g., triphenyl phosphate, tricresyl phosphate, butyl phosphate, octyl phosphate, and cresyl phenyl phosphate), phthalic esters (e.g., dibutyl phthalate, 2-ethylhexyl phthalate, ethyl phthalate, octyl phthalate, and butyl benzyl phthalate), dioctyl tetrahydrophthalate, benzoic esters (e.g., ethyl benzoate, propyl benzoate, butyl benzoate, isopentyl benzoate, and benzyl benzoate), abietic esters (e.g., ethyl abietate and benzyl abietate), dioctyl adipate, isodecyl succinate, dioctyl azelate, oxalic esters (e.g., dibutyl oxalate and dipentyl oxalate), diethyl malonate, maleic esters (e.g., dimethyl maleate, diethyl maleate, and dibutyl maleate), tributyl citrate, sorbic esters (e.g., methyl sorbate, ethyl sorbate, and butyl sorbate), sebacic esters (e.g., dibutyl sebacate and dioctyl sebacate), ethylene glycol esters (e.g., mono- and diesters with formic acid, mono- and diesters with butyric acid, mono- and diesters with lauric acid, mono- and diesters with palmitic acid, mono- and diesters with stearic acid, and mono- and diesters with oleic acid), triacetin, diethyl carbonate, diphenyl carbonate, ethylene carbonate, propylene carbonate, and boric acid esters (e.g., tributyl borate and tripentyl borate). Of these esters, tricresyl phosphate alone or in admixture with other esters is especially preferred because the emulsion obtained using the same is very stable. The oils enumerated above may be used in a combination of two or more thereof or in combination with other oil(s).

An auxiliary solvent as a low-boiling dissolution aid may be added to the above-described organic solvent in the present invention. Especially preferred examples of the auxiliary solvent include ethyl acetate, isopropyl acetate, butyl acetate, and methylene chloride.

The water-soluble polymer incorporated as a protective colloid into the aqueous phase that is mixed with an oil phase comprising the above described ingredients is suitably selected from known anionic, nonionic, and ampholytic polymers. However, poly(vinyl alcohol), gelatin, and cellulose derivatives are especially preferred.

The surfactant incorporated into the aqueous phase is a surfactant which does not cause the protective colloid to precipitate or flocculate, and is suitably selected from anionic and nonionic surfactants. Preferred examples of the surfactant include sodium alkylbenzenesulfonates, sodium alkylsulfates, dioctyl sodium sulfosuccinate, and poly(alkylene glycol)s (e.g., polyoxyethylene nonyl phenyl ether).

The emulsion in the present invention can be easily obtained by mixing an oil phase comprising the ingredients described above with an aqueous phase containing a protective colloid and a surfactant using an ordinary means for microemulsification, e.g., high-speed agitation or ultrasonic dispersion, to disperse the oil phase.

The proportion of the oil phase to the aqueous phase (weight of the oil phase/weight of the aqueous phase) is preferably from 0.02 to 0.6, particularly preferably from 0.1 to 0.4. If the proportion of the oil phase is below 0.02, the concentration of the oil phase is too low because the proportion of the aqueous phase is too large. This results in impaired suitability for production. On the other hand, if the oil-phase proportion is above 0.6, the viscosity of the emulsion is too high. This results in handling difficulty and impaired stability of the coating liquid.

The heat-sensitive recording layer employing a combination of an organic metal salt and a reducing agent is described as follows.

Examples of the organic metal salt include silver salts of long-chain aliphatic carboxylic acids, such as silver laurate, silver myristate, silver palmitate, silver stearate, silver arachate, and silver behenate; silver salts of imino-containing organic compounds, such as the silver salt of benzotriazole, the silver salt of benzimidazole, the silver salt of carbazole, and the silver salt of phthalazinone; silver salts of sulfur compounds, such as an S-alkylthioglycolate; silver salts of aromatic carboxylic acids, such as silver benzoate and silver phthalate; silver salts of sulfonic acids, such as silver ethanesulfonate; silver salts of sulfinic acids, such as silver o-toluenesulfinate; silver salts of phosphoric acids, such as silver phenylphosphate; silver barbiturate; silver saccharinate; the silver salt of salicylaldoxime; and mixtures of these salts. Of these compounds, the silver salts of long-chain aliphatic carboxylic acids are preferred, and silver behenate is especially preferred. Silver behenate may be used in combination with behenic acid.

Reducing agents for use in the present invention are suitably employed in accordance with the description in JP-A-53-1020 from p. 227, left lower column, line 14 to p. 229, right upper column, line 11. Especially preferred reducing agents include mono-, bis-, tris-, or tetrakisphenols, mono- or bisnaphthols, di- or polyhydroxynaphthalenes, di- or polyhydroxybenzenes, hydroxy monoethers, ascorbic acid, 3-pyrazolidone, pyrazoline, pyrazolone, reducing saccharides, phenylenediamine, hydroxyl amines, reductones, hydroxamic acids, hydrazides, amidoximes, N-hydroxyurea, and analogues of these compounds. Of these compounds, especially preferred are aromatic organic reducing agents such as polyphenols, sulfonamidophenols, and naphthols.

The organic metal salt and the reducing agent are added to a solution of a binder (e.g., poly(vinyl butyral)) in an appropriate solvent, e.g., acetone, in the form of fine particles having a 50% volume-average particle diameter of 1.0 μm or smaller, preferably 0.6 μm or smaller. The binder is preferably used in an amount of from 30 to 60% by weight based on the total amount of all solid components of the heat-sensitive recording layer.

For coating a support with the thus-prepared liquid for forming a heat-sensitive layer, a known coating means for applying a water-based or organic-solvent-based coating liquid may be used. In this case, methyl cellulose, carboxymethyl cellulose, hydroxyethyl cellulose, a starch, gelatin, poly(vinyl alcohol), carboxylated poly(vinyl alcohol), polyacrylamide, polystyrene or a styrene copolymer, a polyester or an ester copolymer, polyethylene or an ethylene copolymer, an epoxy resin, an acrylate or methacrylate resin or an acrylate or methacrylate copolymer, a polyurethane resin, a polyamide resin, a poly(vinyl butyral) resin, or the like may be used in the present invention in order to safely and evenly apply the liquid for forming a heat-sensitive layer and to maintain the strength of the coating film.

The heat-sensitive recording layer is preferably coated in an amount such that the total amount of solid components therein is from 1 to 25 $g/m^2$ and the thickness of the layer is from 1 to 25 μm.

In the present invention, a subbing layer is preferably formed on the support prior to forming the heat-sensitive recording layer containing microcapsules etc. and an anti-reflection layer to prevent the heat-sensitive layer from peeling off the support. For forming the subbing layer, an acrylic ester copolymer, poly(vinylidene chloride), SBR, a water-soluble polyester, or the like may be used. The thickness of the subbing layer is preferably from 0.05 to 0.5 μm.

When forming the heat-sensitive recording layer on a subbing layer by coating, the subbing layer may swell due to the water contained in the coating liquid for forming the heat-sensitive recording layer. This may deteriorates images that are recorded on the heat-sensitive recording layer. It is therefore preferable to harden the subbing layer with a hardener. Examples of the hardener include dialdehydes such as glutaraldehyde and 2,3-dihydroxy-1,4-dioxane and boric acid. These hardeners may be added in an amount needed to obtain the desired hardness, in the range of from 0.2 to 3.0% by weight based on the amount of the subbing material.

A protective layer is formed on the heat-sensitive layer in the present invention. For forming a protective layer having satisfactory transparency, the use of wholly saponified poly(vinyl alcohol), carboxylated poly(vinyl alcohol), silica-modified poly(vinyl alcohol), or the like is especially preferred. The protective layer may contain a known hardener, a metal soap, etc.

To evenly form a protective layer on the heat-sensitive recording layer, a surfactant is preferably added to the coating liquid for forming a protective layer. The surfactant may be an alkali metal salt of either a sulfosuccinic acid or a derivative thereof, a fluorine-compound surfactant, etc. Specific examples thereof include sodium or ammonium salts of di(2-ethylhexyl) sulfosuccinate, di(n-hexyl) sulfosuccinate, and the like.

An anti-static substance may be incorporated into the protective layer. Examples of the anti-static substance include surfactants, fine metal oxide particles, inorganic electrolytes, and polymeric electrolytes. The protective layer is coated in a solid amount of generally from 0.2 to 7 g/m$^2$, preferably from 1 to 4 g/m$^2$.

The heat-sensitive recording material of the present invention is produced by forming the heat-sensitive recording layer, protective layer, and subbing layer by a known coating method, e.g., blade coating, air-knife coating, gravure coating, roll coating, spray coating, dip coating, or bar coating.

In order to obtain a transparent heat-sensitive recording material, a transparent support should be used. Examples of the transparent support include films of synthetic polymers such as polyesters, e.g., poly(ethylene terephthalate) and poly(butylene terephthalate), cellulose triacetate, and polyolefins such as polypropylene and polyethylene.

Examples of an opaque support include a paper, coated papers, pigments (such as calcium carbonate) incorporated poly(ethylene terephthalate) films, and synthetic papers.

These films may be used alone or in the form of a laminate of two or more thereof. The thickness of the transparent support is preferably from 25 to 250 μm, and more preferably from 50 to 200 μm.

These synthetic-polymer films may be colored in desired hue. A colored polymer film may be obtained, for example, by a method in which a resin is kneaded with a dye before the resin is formed into a film; and by a method in which a dye is dissolved in an appropriate solvent to prepare a coating liquid, which coating liquid is applied on a transparent and colorless resin film by a known coating technique, e.g., gravure coating, roller coating, or wire coating, and dried. Preferred supports include a film produced by incorporating a blue dye into a polyester resin such as poly(ethylene terephthalate) or poly(ethylene naphthalate) by kneading, forming the dyed resin into a film, and subjecting this film to thermal treatment, stretching, and anti-static treatment.

In particular, the developed heat-sensitive recording material of the present invention may be placed on a light table (shircasten) and observed from the support side. In this case, shircasten light passing through the transparent non-image areas may cause illusion, which make the image indistinct. In order to avoid this problem, it is especially preferred to use, as the transparent support, a synthetic-polymer film which has been dyed in a blue color within the quadrilateral region defined by the four points of A (x=0.2805, y=0.3005), B (x=0.2820, y=0.2970), C (x=0.2885, y=0.3015), and D (x=0.2870, y=0.3040) in the chromaticity coordinate system according to the method described in JIS-Z8701.

An anti-reflection layer containing fine particles having an average particle diameter of generally from 1 to 20 μm, preferably from 1 to 10 μm, may be formed on the side of the support opposite the heat-sensitive recording layer. This anti-reflection layer preferably reduces the gloss as measured at an incident light angle of 20° to an amount of not more than 50%, especially preferably not more than 30%. Examples of such fine particles contained in the anti-reflection layer include fine particles of starches obtained from barley, wheat, corn, rice, and beans, fine particles of synthetic polymers such as cellulose fibers, polystyrene resins, epoxy resins, polyurethane resins, urea-formalin resins, poly(meth)acrylate resins, poly(methyl (meth)acrylate) resins, vinyl chloride/vinyl acetate copolymer resins, and polyolefins, and fine particles of inorganic substances such as calcium carbonate, titanium oxide, kaolin, smectite clay, aluminum hydroxide, silica, and zinc oxide. These finely particulate substances may be used in combination of two or more thereof. For obtaining a heat-sensitive recording material having satisfactory transparency, fine particulate substances having a refractive index of from 1.45 to 1.75 are preferred.

As described above, the heat-sensitive recording material of the present invention has a protective layer which contains a wax comprising wax particles having an average particle diameter of not more than 0.7 μm. The protective layer contains the pigment in an amount of not more than 100 parts by weight per 100 parts by weight of the binder. Therefore, when the recording material is a transparent heat-sensitive recording material, sticking can be prevented without impairing transparency. Thus, the inventive recording material is suitable for image observation with a light table and for image projection with an OHP (over head projector). When the recording material of the present invention is an opaque heat-sensitive recording material, sticking is prevented without resulting in blurry images or causing a decrease in developed-color density.

The present invention is described below in detail by reference to the following Examples, but the invention should not be construed as being limited to thereto. All values of concentration are given in terms of % by weight.

EXAMPLE 1

Preparation of Capsule Dispersion (A):

To 36 g of ethyl acetate were added 19.0 g of the compound represented by structural formula (1):

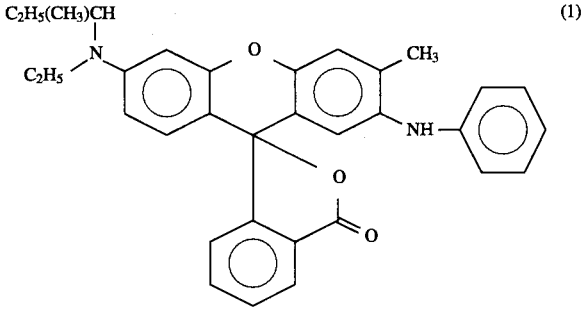

(1)

4.2 g of the compound represented by structural formula (2):

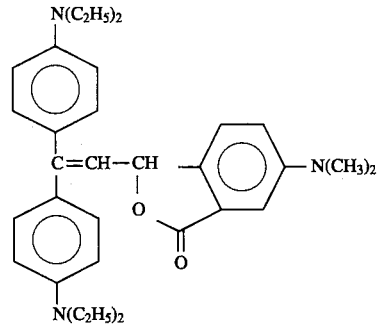

(2)

7.4 g of the compound represented by structural formula (3):

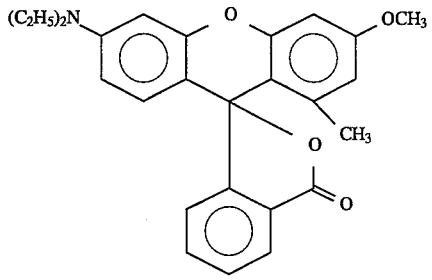

(3)

0.6 g of the compound represented by structural formula (4):

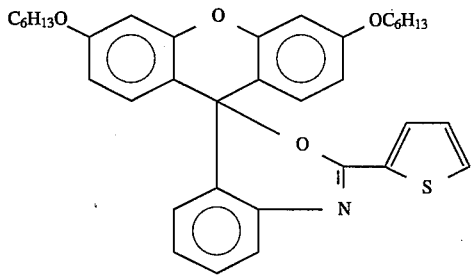

(4)

1.9 g of the compound represented by structural formula (5):

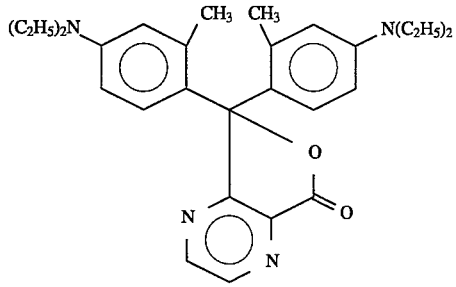

(5)

and 0.8 g of the compound represented by the following structural formula (6).

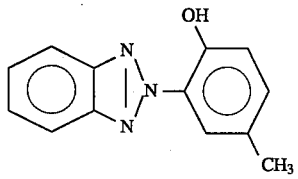

(6)

This mixture was heated to 70° C. to dissolve the compounds and then cooled to 35° C. Thereto were added 0.8 g of n-butanol, 11.2 g of Takenate D119N (trade name for a capsule wall-forming agent manufactured by Takeda Chemical Industries, Ltd., Japan), 4.1 g of Takenate D110N (trade name for a capsule wall-forming agent manufactured by Takeda Chemical Industries, Ltd.), and 10.5 g of Sumidur N3200 (trade name for a capsule wall-forming agent produced by Sumitomo Bayer Urethane Co., Ltd., Japan). This mixture was warmed at 35° C. for 40 minutes. The solution thus obtained was mixed with an aqueous phase prepared by mixing 75 g of an 8 wt% aqueous solution of poly(vinyl alcohol) (PVA 217E, manufactured by Kuraray Co., Ltd., Japan) with 26 g of water. The resulting mixture was agitated with an Ace Homogenizer (manufactured by Nippon Seiki Co., Ltd., Japan) at 10,000 rpm for 5 minutes to emulsify the same. To the thus-obtained emulsion were added 140 g of water and 1.0 g of tetraethylenepentamine. An encapsulation reaction was then conducted at 50° C. for 3 hours to prepare a capsule dispersion having an average particle diameter of 0.7 μm. All average particle diameters are given in terms of the 50% volume-average particle diameter as measured with a laser diffraction type particle size distribution analyzer (LA700, manufactured by Horiba Ltd., Japan).

Preparation of Capsule Dispersion

To 36 g of ethyl acetate were added 19.0 g of the compound represented by structural formula (7):

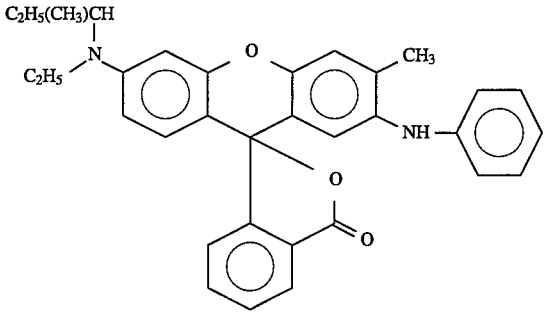

(7)

4.2 g of the compound represented by structural formula (8):

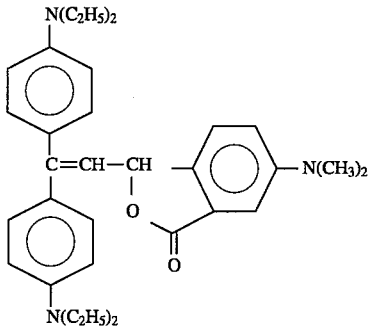

(8)

7.4 g of the compound represented by structural formula (9):

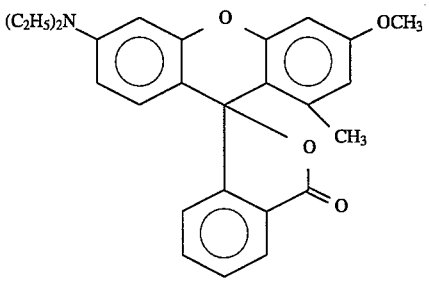

(9)

0.6 g of the compound represented by structural formula (10):

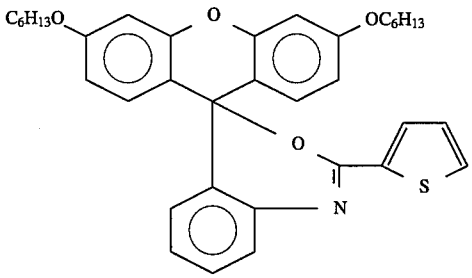

(10)

1.9 g of the compound represented by structural formula (11):

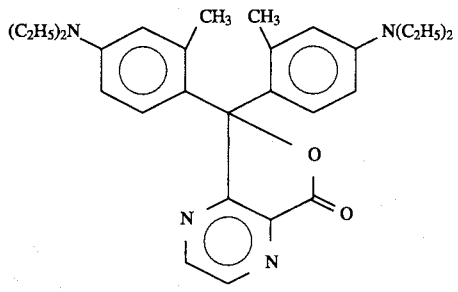

(11)

and 0.8 g of the compound represented by the following structural formula (12).

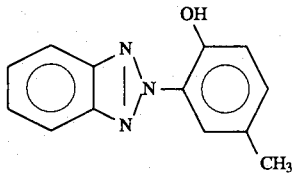

(12)

This mixture was heated to 70° C. to dissolve the compounds and then cooled to 30° C. Thereto were added 15.0 g of Takenate D110N (trade name for a capsule wall-forming agent manufactured by Takeda Chemical Industries, Ltd.) and 10.4 g of Burnock D750 (trade name for a capsule wall-forming agent produced by Dainippon Ink & Chemicals, Inc., Japan). This mixture was warmed at 35° C. for 5 minutes. The solution thus obtained was mixed with an aqueous phase prepared by mixing 75 g of an 8 wt% aqueous solution of poly(vinyl alcohol) (PVA 217E, manufactured by Kuraray Co., Ltd.) with 26 g of water. The resulting mixture was agitated with an Ace Homogenizer (manufactured by Nippon Seiki Co., Ltd.) at 10,000 rpm for 5 minutes to emulsify the same. To the thus-obtained emulsion were added 140 g of water and 1.0 g of tetraethylenepentamine. An encapsulation reaction was then conducted at 50° C. for 3 hours to prepare a capsule dispersion having an average particle diameter of 0.7 μm.

Preparation of Developer Emulsion:

To 15 g of ethyl acetate were added 3.4 g of the compound represented by structural formula (13):

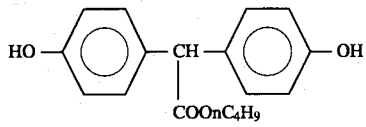

(13)

8.3 g of the compound represented by structural formula (14):

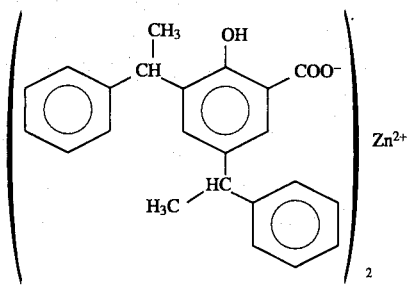

(14)

8.3 g of the compound represented by structural formula (15):

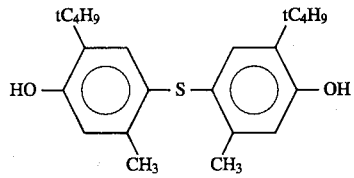

(15)

5.8 g of the compound represented by structural formula (16):

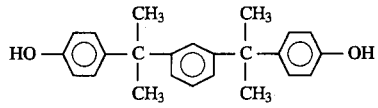

(16)

3.9 g of the compound represented by structural formula (17):

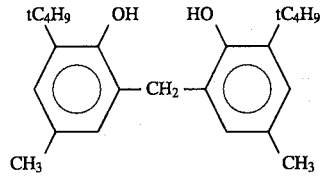

(17)

3.5 g of the compound represented by structural formula (18):

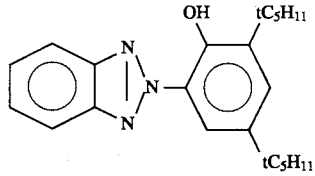

(18)

0.8 g of tricresyl phosphate, and 0.4 g of diethyl maleate. This mixture was heated to 70° C. to dissolve the compounds. The solution thus obtained was added to an aqueous phase prepared by mixing 40 g of a 15 wt% aqueous solution of poly(vinyl alcohol) (PVA 205 C, manufactured by Kuraray Co., Ltd.) with 9 g of a 2.0 wt% aqueous solution of sodium dodecylbenzenesulfonate and 9 g of a 2 wt% aqueous solution of the compound represented by the following structural formula (19).

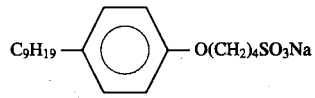

(19)

This mixture was agitated with an Ace Homogenizer (manufactured by Nippon Seiki Co.,Ltd.) at 10,000 rpm to obtain an emulsion having an average particle diameter of 0.7 μm.

Production of Fine Wax Particles:

To 20.0 g of a solid paraffin wax having a melting point of 68–70° C. (manufactured by Kanto Chemical Co., Ltd., Japan) was added 5.0 g of a polyoxyethylene stearyl ether surfactant (Emulgen 320P, manufactured by Kao Corporation, Japan). This mixture was heated to 75° C. to melt the wax. The melt was stirred and added to 60 g of a 5% aqueous solution of poly(vinyl alcohol) (PVA 205, manufactured by Kuraray Co., Ltd.). This mixture was agitated with an Ace Homogenizer (manufactured by Nippon Seiki Co., Ltd.) at 15,000 rpm to prepare an emulsion having an average particle diameter of 0.7 μm. In this emulsification, the homogenizer was placed in a flow of 85° C. hot water so as to carry out the emulsification at a temperature of 75° C. or higher. After emulsification, 8.3 g of warm water was added to the emulsion, which was then gradually cooled to room temperature. Thus, an emulsion of fine wax particles was obtained which had a wax content of 30 wt% and an average particle diameter of 0.7 μm.

Production of Pigment Dispersion for Protective Layer:

To 90 g of water was added 20 g of kaolin (Kaogloss, manufactured by Mizusawa Industrial Chemicals, Ltd., Japan). This mixture was stirred for 3 hours. To 100 g of the resulting dispersion were added 0.5 g of a dispersant manufactured by Kao Corporation (Poiz 532A), 10 g of a 10% aqueous solution of poly(vinyl alcohol) (PVA 105, manufactured by Kuraray Co., Ltd.), 10 g of a 30 wt% zinc stearate dispersion (Z-7-30, manufactured by Chukyo Yushi Co., Ltd., Japan), and 0.5 g of a 10% aqueous solution of sodium dodecylbenzenesulfonate. This mixture was treated with a ball mill to disperse the kaolin to an average particle diameter of 0.8 μm.

Preparation of Protective-Layer Liquid:

A protective-layer liquid was obtained by mixing 50 g of water with 50 g of a 6 wt% aqueous solution of poly(vinyl alcohol) (PVA 124C, manufactured by Kuraray Co., Ltd.), 0.5 g of a 20.5 wt% zinc stearate dispersion (F155, manufactured by Chukyo Yushi Co., Ltd.), a 25 g of 1.0% aqueous boric acid solution, 14 g of the kaolin dispersion described above, 3.0 g of the 30 wt% emulsion of fine wax particles described above, 0.5 g of a 4% aqueous fluoropolymer dispersion (ME413, manufactured by Daikin Industries, Ltd., Japan), 1 g of a 10% aqueous solution of sodium dodecylbenzenesulfonate, 15 g of a 2 wt% aqueous solution of the compound represented by structural formula (20):

$$C_8F_{17}SO_2N(C_3H_7)CH_2COOK \quad (20)$$

and 1.0 g of a 40% aqueous glyoxal solution. The amount of the pigment in the protective layer was 67 parts by weight per 100 parts by weight of the binder.

Preparation of Capsules for Ultraviolet Filter Layer:

To 8.2 g of ethyl acetate were added 1.58 g of the compound represented by structural formula (21):

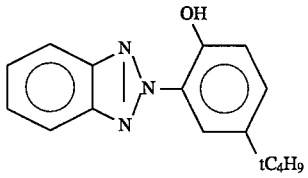

(21)

6.3 g of the compound represented by structural formula (22):

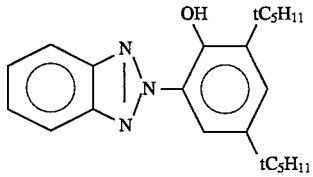

(22)

5.2 g of the compound represented by structural formula (23):

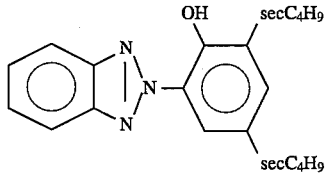

(23)

1.4 g of the compound represented by structural formula (24):

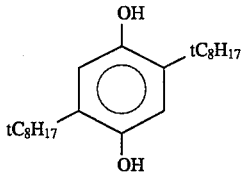

(24)

and 7.3 g of the compound represented by the following structural formula (25).

$$O{=}P{-}(OCH_2CH_2CH(CH_3)CH_2C(CH_3)_2CH_3)_3 \quad (25)$$

This mixture was heated to 70° C. to obtain a solution, which was then cooled to 35° C. Thereto were added 0.9 g of Takenate D110N (trade name for a capsule wall-forming agent manufactured by Takeda Chemical Industries, Ltd.) and 0.3 g of Burnock D750 (trade name for a capsule wall-forming agent manufactured by Dainippon Ink & Chemicals Inc.). This mixture was warmed at 35° C. for 5 minutes. The resulting solution was mixed with an aqueous phase obtained by mixing 120 g of a 15 wt% aqueous solution of poly(vinyl alcohol) (PVA 205, manufactured by Kuraray Co., Ltd.) with 8.0 g of a 10 wt% aqueous solution of sodium dodecylbenzenesulfonate. The resulting mixture was agitated with an Ace Homogenizer (manufactured by Nippon Seiki Co., Ltd.) at 15,000 rpm for 15 minutes to obtain an emulsion having a 50% volume-average particle diameter of 0.25 μm. To the thus-obtained emulsion were added 60 g of water and 0.15 g of tetraethylenepentamine. An encapsulation reaction was then conducted at 40° C. for 3 hours to prepare a capsule dispersion having an average particle diameter of 0.25 μm.

Preparation of Coating Liquid for Ultraviolet Filter Layer:

To a mixture of 42.31 g of water and 40.0 g of a 10 wt % silanol-modified poly(vinyl alcohol) (R2105, manufactured by Kuraray Co., Ltd.) was added 13.5 g of the above-described capsule dispersion for an ultraviolet filter layer (solid content, 24.2%). This mixture was mixed with 17 g of a 50 wt % aqueous solution of the compound represented by structural formula (26):

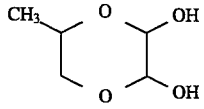

(26)

and 65 g of 20% colloidal silica (Snowtex O, manufactured by Nissan Chemical Industries, Ltd., Japan). A coating liquid for an ultraviolet filter layer was thus prepared.

Preparation of Coating Liquid for Back Coat Layer:

To 50 g of water was added 0.1 g of rice starch having an average particle diameter of 5 μm (manufactured by Matsutani Kagaku Kogyo Co., Ltd., Japan). After the starch was sufficiently dispersed, this dispersion was mixed with 2.5 g of a 2 wt % aqueous solution of di(2-ethylhexyl) sulfosuccinate, 1.5 g of a 2 wt % aqueous solution of the compound represented by structural formula (27):

$$C_8F_{17}SO_2N(C_3H_7)CH_2COOK \quad (27)$$

and 17 g of 20% colloidal silica (Snowtex O, manufactured by Nissan Chemical Industries, Ltd.). A coating liquid for a back coat layer was thus prepared.

Production of Transparent Support:

A 175 μm-thick poly(ethylene terephthalate) (PET) film which had been colored blue as defined by x=0.2850 and y=0.2995 in the chromaticity coordinate system described in JIS-Z8701 was coated on one side with an SBR latex in an amount of 0.3 g/m$^2$ on a dry basis. A coating liquid prepared by mixing 200 g of a 5 wt % aqueous solution of gelatin (Nitta Gelatin #810) with 0.5 g of a 5 wt % gelatin dispersion of poly(methyl methacrylate) resin particles having a particle diameter of 2 μm (poly(methyl methacrylate) resin content, 10 wt %), 1.0 g of a 3 wt % aqueous 1,2-benzothiazolin-3-one solution, and 10 g of a 2 wt % aqueous solution of di(2-ethylhexyl) sulfosuccinate was applied to the SBR-coated surface in an amount of 0.1 g/m$^2$ on a dry basis. The other side of the film was then coated in the same manner.

Production of Heat-Sensitive Recording Material:

The coating liquid for an ultraviolet filter layer described above was applied to one side of the both-side-coated support in an amount of 1.8 g/m$^2$ on a dry basis, and dried. Subsequently, the coating liquid for a back coat layer described above was applied to the thus-formed ultraviolet filter layer in an amount of 2.2 g/m$^2$ on a dry basis, and dried. A mixture of 4.2 g of capsule dispersion (A) described above (solid content, 27%), 10.0 g of capsule dispersion (B) described above (solid content, 27%), 40 g of the developer emulsion described above (solid content, 21 wt %), and 0.4 g of a 50 wt % aqueous solution of the compound represented by structural formula (28):

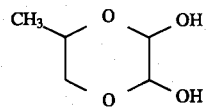

(28)

was applied to the support on the side opposite to the ultraviolet filter layer and the back coat layer in an amount of 13.5 g/m$^2$ on a dry basis, and dried. Subsequently, the coating liquid for a protective layer described above was applied to the thus-formed coating film in an amount of 2.5 g/m$^2$ on a dry basis, and dried. A heat-sensitive recording material of the present invention was thus obtained.

The heat-sensitive recording material thus obtained was subjected to recording using a thermal printer (FTI-1000, manufactured by Fuji Photo Film Co., Ltd.) to record thereon 20 cm-long images in which the degree of blackness ranged from 0% to 100% in increments of 10% in the direction of main scanning. As a result, the printing operation produced little sticking noise, and good quality images were obtained. Furthermore, there were no uncolored areas resulting from defective color development. The haze which indicates the transparency of the background was 35%. The value of haze was measured with a haze meter HGM-2DP (manufactured by Suga Test Instruments Co., Ltd., Japan). Haze is represented by (diffusion transmittance/total light transmittance)×100 (%); the lower the haze value, the higher the transparency.

EXAMPLE 2

A heat-sensitive recording material was produced in the same manner as in Example 1, except that the emulsion of fine wax particles was adjusted to have an average particle diameter of 0.4 μm.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 32%.

EXAMPLE 3

A heat-sensitive recording material was produced in the same manner as in Example 2, except that a paraffin wax having a melting point of 54°–56° C. was used.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 32%.

EXAMPLE 4

A heat-sensitive recording material was produced in the same manner as in Example 1, except that polyethylene wax having a melting point of 90° C. was used.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced a sticking noise slightly louder than in Example 1, and the images thus obtained had one uncolored area resulting from defective color development (a break of printing over the entire length of a line) per 20-cm recording. However, these results were satisfactory and acceptable for practical use. The haze which indicates the transparency of the recording material was 34%.

EXAMPLE 5

To 5 g of the diazonium compound represented by structural formula (29):

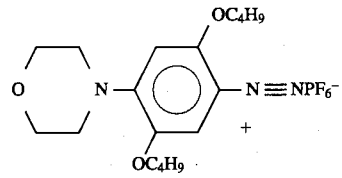

(29)

were added 15 g of methylene chloride, 5 g of tricresyl phosphate, 15 g of trimethylolpropane trimethacrylate, and 20 g of a 75 wt % ethyl acetate solution of a 3:1 adduct of m-xylylene diisocyanate with trimethylolpropane (Takenate D110N, manufactured by Takeda Chemical Industries, Ltd.). This mixture was stirred to produce a homogeneous oil phase solution.

The oil phase solution thus obtained was mixed with an aqueous phase consisting of 60 g of a 7 wt % aqueous solution of poly(vinyl alcohol) (PVA 217E, manufactured by Kuraray Co., Ltd.), and this mixture was agitated with an Ace Homogenizer (manufactured by Nippon Seiki Co., Ltd.) at 8,000 rpm for 5 minutes to emulsify the same. To the thus-obtained emulsion was added 50 g of water. An encapsulation reaction was then conducted at 40° C. for 3 hours to prepare a capsule dispersion having an average particle diameter of 1.5 μm. To this dispersion was added 10 ml of an ion-exchange resin (MB-3, manufactured by Japan Organo Co., Ltd., Japan). This mixture was stirred for 30 minutes and then filtered to obtain a capsule dispersion.

Into 25 g of ethyl acetate were dissolved 4.3 g of the coupler compound represented by structural formula (30):

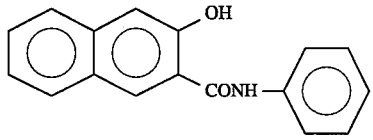

(30)

0.7 g of the coupler compound represented by structural formula (31):

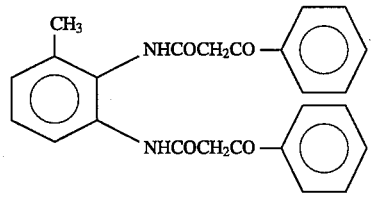

(31)

5 g of 1,2,3-triphenylguanidine, 0.8 g of tricresyl phosphate, and 0.2 g of diethyl maleate. The solution thus obtained was mixed with an aqueous phase prepared by mixing 40 g of a 8 wt % aqueous poly(vinyl alcohol) solution with 15 g of water and 0.5 g of sodium dodecylbenzenesulfonate. This mixture was agitated with an Ace Homogenizer (manufactured by Nippon Seiki Co., Ltd.) at 10,000 rpm to obtain an emulsion having an average particle diameter of 0.5 μm.

Production of Heat-Sensitive Recording Material:

The coupler emulsion obtained above (solid content, 16 wt %) was mixed in an amount of 15 g with 5.0 g of the capsule dispersion described above (solid content, 25 wt %) containing a diazonium compound. This mixture was applied to the support used in Example 1, in an amount of 15 g/m$^2$ on a solid basis. The coating was dried to form a heat-sensitive recording layer. The coating liquid for a protective layer used in Example 1 was then applied to the thus-formed heat-sensitive recording layer in an amount of 2.5 g/m$^2$ on a dry basis, and dried to produce a transparent heat-sensitive recording material.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 31%.

EXAMPLE 6

Preparation of Silver Behenate Dispersion:

Three liters of distilled water, 120 g (0.35 mol) of behenic acid, 14.1 g of a 0.12 mol % aqueous sodium hydroxide solution, 1 ml of a 0.56 mol % dilute nitric acid solution, and 59.25 g of a 0.23 mol % aqueous silver nitrate solution were prepared. The 3-liters of distilled water were placed in a 5-liter round-bottom flask equipped with a Hirechberg agitator and a heating mantle. After the contents were heated to about 80° C., the 120 g of behenic acid (0.35 mol) was added thereto. The resulting mixture was vigorously agitated until the acid was finely dispersed (for about 20 minutes), and the 14.1 g of aqueous sodium hydroxide solution was quickly added thereto dropwise using a dropping funnel.

Subsequently, the reaction mixture was stirred until it turned into a milky colloid, which operation took 30 minutes. The 1 ml of dilute nitric acid solution was then added thereto to consume all of the remaining free hydroxide. After the dispersion was cooled to about 50° C., the 59.25 g of aqueous silver nitrate solution was added dropwise to the dispersion over a period of 30 minutes with vigorous agitation. The dispersion was continuously stirred until the viscosity thereof considerably decreased, and thereafter stirred for an additional 20 minutes so that all of the reactants were consumed.

The excess silver behenate was recovered from the dispersion by filtration with a Buchner funnel. The recovered silver behenate was slurried with 2 liters of distilled water, and the slurry was filtered. The silver behenate was then washed with distilled water until addition of sodium chloride to the filtrate did not yield silver chloride. The washed silver behenate was dried at 50° C. for several days until a constant weight was reached. A solution of 10 g of poly(vinyl butyral) (Butvar B-76, trade name of Monsanto Co.) in a mixed solvent consisting of 220 g of methyl ethyl ketone, 60 g of toluene, and 50 g of methyl isobutyl ketone was mixed with 100 g of the dry silver behenate obtained above. This mixture was treated with a ball mill for 48 hours to disperse the silver behenate. Thus, a dispersion of silver behenate in a poly(vinyl butyral) solution was obtained which dispersion contained 5.5 wt % silver in the form of silver behenate.

Preparation of Coating Liquid for Heat-Sensitive Layer:

To 100 g of the silver behenate dispersion described above was added 325 g of ethyl alcohol. This mixture was stirred until it became homogeneous. Thereto was then added 2 ml of a solution prepared by dissolving 0.1 mol of silver bromide in 20 ml of methyl alcohol. To this mixture was added 46 g of a 10 wt % acetone solution of poly(vinyl butyral). To 20 g of the resulting dispersion were added 0.3 g of 2-(4-hydroxy-3,5-dimethoxy)-4,5-bis(P-methoxyphenyl)imidazole, 0.2 g of phthalazinone, and 0.1 g of 1,2,3-benzotriazin-4(3H)-one. A coating liquid for heat-sensitive layer was thus obtained.

The coating liquid for heat-sensitive layer described above was applied to the support used in Example 1, in an amount of 20 g/m$^2$ on a solid basis. The coating was dried to form a heat-sensitive recording layer. The coating liquid for protective layer used in Example 1 was then applied to the thus-formed heat-sensitive recording layer in an amount of 2.5 g/m$^2$ on a dry basis, and dried to produce a transparent heat-sensitive recording material.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 33%.

EXAMPLE 7

A heat-sensitive recording material was produced in the same manner as in Example 2, except that in the preparation of a coating liquid for protective layer, the addition amount of the emulsion of fine wax particles was changed to 7 g. The pigment amount in the protective layer was 35 parts by weight per 100 parts by weight of the binder.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 28%.

EXAMPLE 8

To 100 g of a 5% aqueous solution of poly(vinyl alcohol) (PVA-105, manufactured by Kuraray Co., Ltd.) was separately added each of 20 g of 2-anilino-3-methyl-6-dibutylaminofluoran as an electron-donating colorless dye, 20 g of bisphenol A as an electron-accepting compound, and 20 g of 2-benzyloxynaphthalene as a sensitizer. These mixtures were each treated with a ball mill for a whole day and night to disperse the solid ingredients, to thereby obtain dispersions each having an average particle diameter of not more than 1.5 μm. On the other hand, a mixture of 80 g of calcium carbonate (Unibur 70, manufactured by Shiraishi Kogyo K.K, Japan) and 160 g of a 0.5% sodium hexametaphosphate solution was treated with a homogenizer to obtain a pigment dispersion. The dispersions thus prepared were mixed together in such a proportion that the amounts of the dispersion of the electron-donating colorless dye, the dispersion of the electron-accepting compound, the dispersion of 2-benzyloxynaphthalene, and the dispersion of calcium carbonate were 5 g, 10 g, 10 g, and 5 g, respectively. Furthermore, 3 g of a 21% zinc stearate emulsion (Hidorin Z-7, manufactured by Chukyo Yushi Co., Ltd.) was added to the mixture to obtain a heat-sensitive coating liquid. This coating liquid for heat-sensitive color-developing layer was applied to a wood-free paper having a basis weight of 50 g/m$^2$ using a wire-wound bar in an amount of 4.0 g/m$^2$ on a dry basis, and then dried at 50° C. for 1 minute to obtain a heat-sensitive recording layer. A protective layer was formed on this heat-sensitive recording layer in the same manner as in Example 1 to obtain an opaque, reflection type heat-sensitive recording material.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality were obtained. Furthermore, there were no uncolored areas resulting from defective color development. The developed-color density as measured with a Macbeth densitometer (RD918) was 1.40, and the images thus obtained were clear and sharp.

Comparative Example 1

A heat-sensitive recording material was produced in the same manner as in Example 1, except that the emulsion of fine wax particles was not added to the coating solution for the protective layer.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced a sticking noise. The images thus obtained had five uncolored areas resulting from defective color development (breaks of printing over the entire length of lines) per 20-cm recording. These defects were at an undesirable level in terms of image observation. The haze which indicates the transparency of the recording material was 30%.

Comparative Example 2

A heat-sensitive recording material was produced in the same manner as in Example 1, except that the emulsion of fine wax particles was adjusted to have an average particle diameter of 1.2 μm.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. However, the haze was 53%, which shows that this recording material had a low transparency.

Comparative Example 3

A heat-sensitive recording material was produced in the same manner as in Example 1, except that the emulsion of fine wax particles was adjusted to have an average particle diameter of 0.9 μm.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. However, the haze was 45%, which shows that this recording material had a low transparency.

Comparative Example 4

To 100 g of hexane were added 20 g of polyethylene wax having a melting point of 105° C. and 5.0 g of a polyoxyethylene stearyl ether surfactant (Emulgen 320P, manufactured by Kao Corporation). This mixture was heated to dissolve the wax. The resulting solution was added to 100 g of a 3.3% aqueous solution of poly(vinyl alcohol) (PVA 205, manufactured by Kuraray Co., Ltd.) heated to 75° C., and this mixture was agitated with an Ace Homogenizer (manufactured by Nippon Seiki Co., Ltd.) at 15,000 rpm to prepare an emulsion having an average particle diameter of 0.7 μm. In this emulsification, the homogenizer was placed in a flow of 95° C. hot water so as to heat the contents. After emulsification, the emulsion was heated in a rotary evaporator at 80° C. under reduced pressure to remove the hexane, and then gradually cooled to room temperature. Thus, a 25 wt % emulsion of fine wax particles was obtained. A heat-sensitive recording material was produced in the same manner as in Example 1, except that 3.6 g of this emulsion of fine wax particles was used for preparing a coating liquid for the protective layer.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced a sticking noise.

The images thus obtained had three uncolored areas resulting from defective color development (breaks of printing over the entire length of lines) per 20-cm recording. These defects were at an undesirable level in terms of image observation. The haze which indicates the transparency of the recording material was 35%.

Comparative Example 5

A heat-sensitive recording material was produced in the same manner as in Example 1, except that a liquid paraffin having a melting point of 30° C. was used instead of the fine wax particles in the coating solution for the protective layer.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. The haze which indicates the transparency of the recording material was 34%. However, the protective layer was tacky which resulted in blocking.

Comparative Example 6

A heat-sensitive recording material was produced in the same manner as in Example 2, except that in the preparation of a coating liquid for protective layer, the addition amount of the emulsion of fine wax particles was changed to 25 g. As a result, the addition amount of the pigment in the protective layer was 116 parts by weight per 100 parts by weight of the binder.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. However, the haze which indicates the transparency of the recording material disadvantageously was as high as 41%.

Comparative Example 7

A heat-sensitive recording material was produced in the same manner as in Example 8, except that the emulsion of fine wax particles was not added to the coating solution for the protective layer.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced a sticking noise. The images thus obtained had four uncolored areas resulting from defective color development (breaks of printing over the entire length of lines) per 20-cm recording. These defects were at an undesirable level in terms of image observation. The developed-color density was 1.42, and the images thus obtained were clear and sharp.

Comparative Example 8

A heat-sensitive recording material was produced in the same manner as in Example 8, except that in the preparation of a coating liquid for protective layer, the addition amount of the emulsion of fine wax particles was changed to 25 g. As a result, the addition amount of the pigment in the protective layer was 116 parts by weight per 100 parts by weight of the binder.

The heat-sensitive recording material thus obtained was subjected to recording using a thermal printer (FTI-1000, manufactured by Fuji Photo Film Co., Ltd.) to record images in which the degree of blackness ranged from 0% to 100% in increments of 10% in the direction of main scanning. As a result, the printing operation produced little sticking noise and good quality images were obtained. Furthermore, there were no uncolored areas resulting from defective color development. However, the developed-color density was as low as 1.30, and the images thus obtained were blurry.

The above noted results that were obtained in the Examples and Comparative Examples demonstrate the effectiveness of the present invention.

While the invention has been described in detail and with reference to specific examples thereof, it will be apparent to one skilled in the art that various changes and modifications can be made therein without departing from the spirit and scope thereof.

What is claimed is:

1. A heat-sensitive recording material comprising a support, having thereon in the following order, a heat-sensitive recording layer and a protective layer comprising a pigment, a binder and a wax, wherein said wax has a melting point of from 40° C. to 100° C. and said wax comprises wax particles having a 50% volume-average particle diameter of from not less than 0.2 μm to not more than 0.7 μm, and said protective layer contains said pigment in an amount of from not less than 0.1 parts to not more than 100 parts per 100 parts by weight of the binder.

2. The heat-sensitive recording material as claimed in claim 1, wherein said heat-sensitive recording material has a haze value represented by formula (A)

$$\frac{\text{diffusion transmittance}}{\text{total light transmittance}} \times 100\ (\%) \qquad \text{(A)}$$

of not more than 40%.

3. The heat-sensitive recording material as claimed in claim 2, wherein said wax particles have a 50% volume-average particle diameter of not more than 0.4 μm.

4. The heat-sensitive recording material as claimed in claim 3, wherein said protective layer contains said pigment in an amount of not more than 50 parts per 100 parts by weight of binder.

5. The heat-sensitive recording material as claimed in claim 2, wherein said protective layer contains said pigment in an amount of not more than 50 parts per 100 parts by weight of binder.

6. The heat-sensitive recording material as claimed in claim 1, wherein said wax particles have a 50% volume-average particle diameter of not more than 0.4 μm.

7. The heat-sensitive recording material as claimed in claim 6, wherein said protective layer contains said pigment in an amount of not more than 50 parts per 100 parts by weight of binder.

8. The heat-sensitive recording material as claimed in claim 1, wherein said protective layer contains said pigment in an amount of not more than 50 parts per 100 parts by weight of binder.

9. The heat-sensitive recording material as claimed in claim 1, wherein the wax has a melting point of from 55° C. to 75° C.

10. The heat-sensitive recording material as claimed in claim 1, wherein the protective layer contains the wax in an amount of from 0.5 to 40% by weight based on the total weight of the protective layer.

11. The heat-sensitive recording material as claimed in claim 1, wherein said protective layer is coated in an amount of from 4.2 to 7 $g/m^2$ on a solid basis.

* * * * *